United States Patent [19]

Thede

[11] Patent Number: 4,779,368

[45] Date of Patent: Oct. 25, 1988

[54] DISPLAY FRAME FOR PHOTOGRAPHS OR THE LIKE

[76] Inventor: James S. Thede, 740 The Alameda, Berkeley, Calif. 94707

[21] Appl. No.: 66,469

[22] Filed: Jun. 26, 1987

[51] Int. Cl.[4] ..... G09F 1/12

[52] U.S. Cl. ..... 40/152.1; 248/489; 40/156; 40/155; 40/661

[58] Field of Search ..... 40/152.1, 617, 10 D, 40/155, 158; 248/489

[56] References Cited

U.S. PATENT DOCUMENTS

| | | | |
|---|---|---|---|
| 2,540,907 | 2/1951 | Paschall | 40/153 |
| 4,091,555 | 5/1978 | Korzon | 40/152.1 |
| 4,310,976 | 1/1982 | Wilten | 40/152.1 |
| 4,330,952 | 5/1982 | Swanson | 40/152.1 |
| 4,424,637 | 1/1984 | Leahy | 40/152 |

*Primary Examiner*—Gene Mancene

*Assistant Examiner*—Wenceslao J. Contreras

*Attorney, Agent, or Firm*—Harris Zimmerman; Howard Cohen

[57] ABSTRACT

A frame for displaying one or more photographs or the like on a wall has parallel front and back panels between which the photographs or the like may be disposed. The frame is suspended from a hook or other projection on the wall by a length of flexible filament which has end portions that extend through passages at opposite side regions of the back panel and engage the front panel. Consequently the weight of the suspended frame urges the two panels together and additional fasteners are not necessarily needed. All components including the front and back panels and the filament are formed of transparent material in embodiments where it is desired to de-emphasize the presence of a display frame and to simulate the appearance of photographs or the like that are directly attached to a wall.

13 Claims, 1 Drawing Sheet

DISPLAY FRAME FOR PHOTOGRAPHS OR THE LIKE

TECHNICAL FIELD

This invention relates to picture frames and more particularly to frames of the type in which one or more photographs, paintings, posters or the like are disposed between a back panel and a transparent front panel and which include means for suspending the frame from a hook or other projection on a wall.

BACKGROUND OF THE INVENTION

It is preferable under some circumstances to display photographs or the like on a wall in a construction which lacks the open framework that forms the border of a traditional picture frame. This may be desirable for esthetic purposes, to simplify the construction of the frame, to reduce the complications involved in mounting photographs in the frame or for a number of other reasons. The framework is particularly undesirable in situations where it desired to de-emphasize the presence of a frame and to create the appearance of photographs or the like which are directly fastened to the wall.

For the above described reasons, photographs or the like are sometimes disposed between flat parallel panels, the front panel being transparent. A length of wire, cord or other filament connected to opposite side regions of the back of the frame enables suspension of the display from a hook or other projection on the wall.

As the traditional open framework border is not present, additional components have heretofore been needed for the purpose of holding the panels together and in order to enable connection of the suspension wire, cord or the like to the frame. Such components complicate the frame construction and the process of assembling the frame and photographs or the like.

The conventional constructions are particularly disadvantageous in some situations where it is desired to display an array of several photos or the like in a single frame. If the photos are to be spaced apart or are of different sizes, portions of the opaque back panel are prominently visible within the array of photos. The clamps, screws or other fasteners which are used to hold the panels together are also noticeably visible.

A low visibility display frame, which simulates the appearance of photos or the like that are directly and individually fastened to the wall would be advantageous in such situations.

The present invention is directed to overcoming one or more of the problems discussed above.

SUMMARY OF THE INVENTION

In one aspect, the present invention provides a frame for displaying one or more photographs or the like on a wall, the frame having a flat back panel to which one or more photographs or the like may be attached and having a flat transparent front panel. The frame further includes fastening means for holding the panels together and a filament connected to opposite edge regions of the frame for suspending the frame from a protuberance on the wall. The back panel is transpierced by first and second passages situated at first and second opposite edge regions of the back panel. The filament has a central portion situated behind the back panel and has first and second end portions which respectively extend through the first and second passages of the back panel and engage the front panel. Thus the weight of the panels acts to hold the panels together when the frame is suspended from the wall protuberance by the filament.

In another aspect of the invention, both the back panel and the filament are formed of transparent material.

In another aspect of the invention, a frame for displaying one or more photographs or the like at a wall has parallel front and back panels of similar size and configuration, the panels being transpierced by a pair of passages which are situated at opposite side regions of the panels and which are equidistantly spaced from the top of the panels. A filament for suspending the frame from a protuberance on the wall has a central portion situated behind the back panel and end portions which extend through separate ones of the passages to the front of the front panel. The frame further includes means for preventing withdrawal of the end portions of the filament from the passages.

In still another aspect, the invention provides a low visibility frame for displaying at least one photograph or the like on a wall, the frame having parallel front and back panels between which the photograph or the like may be disposed. The frame further includes a filament having a central portion situated behind the back panel for suspending the frame from a projection on the wall, opposite ends of the filament being connected to opposite side regions of the frame and further includes fastening means for holding the panels together when the frame is suspended from the projection. Each of the panels and the filament and the fastening means are transparent.

The invention provides a very simple and economical display frame construction in which the front and back panels are inherently held together by the interconnection of the suspension filament with the panels. Additional fastening devices for holding the panels together are not necessarily required. All necessary components of the frame can be transparent in situations where it is desired to de-emphasize the presence of a frame and to simulate the appearance of photographs or the like which are directly and individually fastened to a wall.

DETAILED DESCRIPTION OF THE PREFERRED EMBODIMENT

Figure 1:
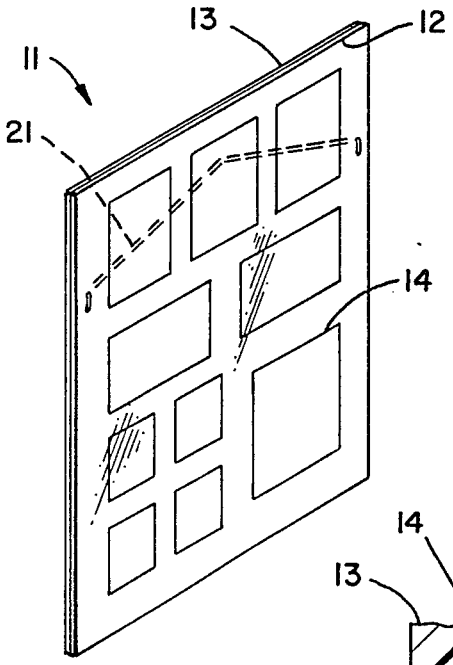
FIG. 1 is a perspective view of a display frame in accordance with a preferred embodiment of the invention.

Referring initially to FIG. 1 of the drawings, a display frame 11 in accordance with the invention includes flat parallel front and back panels 12 and 13 respectively between which one or more photographs 14 or the like may be disposed. The panels 12 and 13 of this embodiment are rectangular and of similar size but may have other configurations, such as a circular or oval shape for example, if desired.

The display frame 11 will be herein described as a means for displaying an array of several photographs 14. The display frame 11 is equally applicable to supporting a single large photograph 14 and to the display of other subjects such as paintings, posters, bulletin board notices, historical documents or the like.

This embodiment of the invention is designed to be a low visibility display frame 11 which, on casual viewing at least, simulates the appearance of photographs 14 which are fastened directly to a wall. For this purpose, the back panel 13 as well as the front panel 12 is formed of transparent material such as clear plastic for example. Use of known transparent materials which have non-glare surfaces treated to reduce light reflection can further contribute to this objective.

Figure 2:
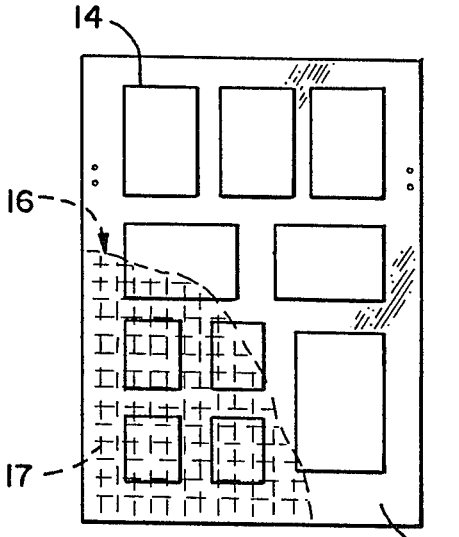
FIG. 2 is an elevation view of the back panel of the display frame shown with an array of photographs attached thereto.
Figure 3:
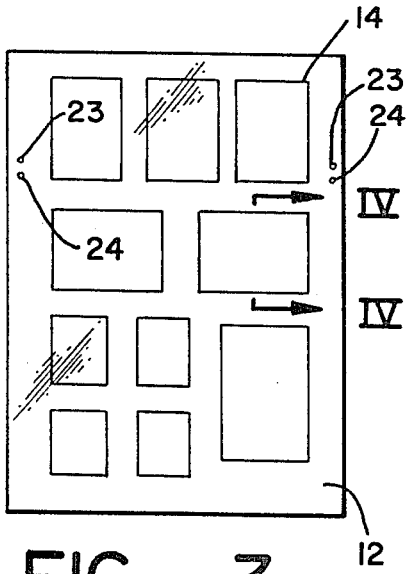
FIG. 3 is an elevation view of the assembled front and back panels.

Referring to FIGS. 2 and 3 in conjunction, the display frame 11 is assembled by fastening the photographs 14 to the face of the back panel 12 in a desired arrangement. As the back panel 13 is transparent, alignment and orientation of the photographs 14 can be facilitated by temporarily disposing a sheet of paper 16 or the like behind the back panel, the paper being of the type having a grid 17 of orthogonal lines imprinted thereon along which the edges of the photographs can be aligned.

Figure 4:
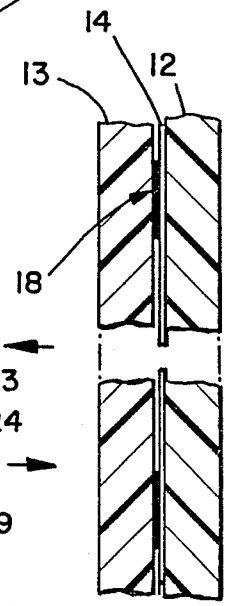
FIG. 4 is a cross section view taken along line IV—IV of FIG. 3.

Referring to FIG. 4, a particularly advantageous procedure for fastening the photographs 14 to back panel 13 is to dispose one or more lengths of adhesive tape 18 between each photograph and the back panel, the tape being of the type which has adhesive on both surfaces. Referring to FIG. 3, front panel 12 is then overlaid on the back panel 13 and photographs 14.

Figure 7:
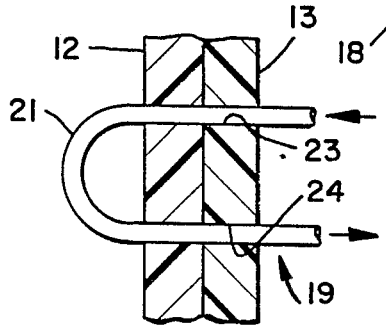
FIG. 7 is a cross section view corresponding generally to FIG. 6 but illustrating the apparatus at an intermediate stage of assembly.
Figure 5:
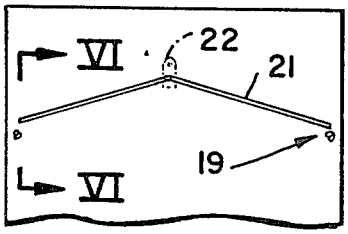
FIG. 5 is an elevation view of the back of the upper portion of the assembled display frame.

Referring jointly to FIGS. 3 and 5, the assembled front and back panels 12 and 13 are held together by end portions 19 of the flexible filament 21 which also provides for suspension of the display frame 11 from a hook 22 or other object that projects from a wall. In particular, a pair of vertically spaced apart passages including an upper passage 23 and lower passage 24 extends through both panels 12 and 13 at both side regions of the panels, the pairs of passages being equidistantly spaced from the top of the panels and being situated in the upper half of the panels. Referring to FIG. 7, the panels 12, 13, are fastened together by threading a separate end portion 19 of filament 21 through each upper passage 23 from the rear of the back panel and then returning the end portions to the rear of the display frame 11 through the lower passages 24. A knot 26, of larger diameter than the lower passage 24 is then formed in each end portion 19 as depicted in FIG. 6.

The filament 21 of this embodiment, like the back panels 12 and 13, is formed of transparent material to de-emphasize the presence of a display frame 11. One example of a suitable thin, flexible, high strength and essentially transparent material is Nylon (trademark) monofilament of the type used for fishing line.

Figure 6:
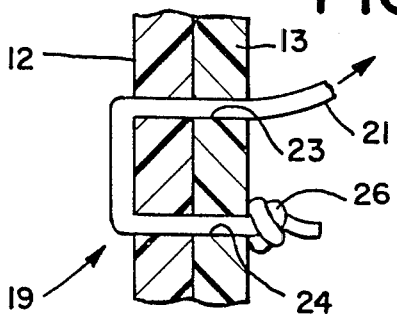
FIG. 6 is a cross section view taken along line VI—VI of FIG. 5.

Referring to FIGS. 5 and 6 in conjunction, the above described interconnecton of end portions 19 of filament 21 with panels 12 and 13 causes the weight of the display frame 11 to hold the panels together in register with each other when the display frame 11 is suspended from a hook 22 or the like against a wall. Referring to FIG. 4, gravitationally induced tension in filament 21 continuously urges the front panel 12 against the back panel 12 thereby applying pressure to the photographs 14 and adhesive tape 18 which prevents shifting or drooping of the photos.

The display frame 11 can be easily opened to change the photographs 14 without requiring removal of brads or disengagement of screws, clamps or the like as in prior constructions. The panels 12 and 13 are separable when the frame 11 has been lifted from hook 22 to relieve the gravity induced tension in filament 21. The filament 21 may be cut and replaced with new filament when the frame 11 is reassembled.

Referring again to FIG. 6, it is possible to hold the panels 12 and 13 together through the gravitational effect by locating the knots 26 at the face of the front panel 12 immediately in front of the upper passages 23. Doubling back of the filament end portions 19 through lower passages 24 as in the present embodiment has the advantage of making the knots 26 less visible and also less exposed to damage.

Thus the construction does not require a highly visible framework border nor metallic or bulky fasteners that can also be highly noticeable. The panels 12 and 13 are held together during use by portions of the suspension filament 21 itself all of which components can readily be made of transparent material in instances where it is desired to de-emphasize the presence of the frame 11.

While the invention has been described with respect to a single preferred embodiment, modifications and variations of the construction are possible within the scope of the invention and it is not intended to limit the invention except as defined in the following claims.

I claim:

1. A frame for displaying one or more photographs or the like on a wall, said frame having a flat back panel to which one or more photographs or the like may be attached and having a flat transparent front panel disposed in parallel relationship with said back panel, and having fastening means for holding said panels together after one or more photographs or the like have been attached to said back panel, and having a filament connected to opposite edge regions of said frame for suspending said frame from a projection on said wall, wherein the improvement comprises:

said back panel being transpierced by first and second passages situated at first and second opposite edge regions of said back panel, and wherein said filament has a central portion situated behind said back panel and has first and second end portions which respectively extend through said first and second passages of said back panel and engage said front panel, whereby the weight of said panels acts to create tension in said filament which urges said panels together when said frame is suspended from said wall projection by said filament.

2. The frame of claim 1 wherein said back panel is transparent.

3. The frame of claim 1 wherein both said back panel and said filament are formed of transparent material.

4. The frame of claim 3 wherein end portions of said transparent filament have knots formed thereon located to prevent withdrawal of said end portions from said passages.

5. The frame of claim 1 wherein said first and second passages in said back panel extend on through said front panel and wherein said front and back panels have a third passage extending therethrough at said first edge region and a fourth passage extending therethrough at said second edge region, and wherein said first and second end portions of said filament extend to the front of said front panel through said first and second passage respectively and return to the back of said back panel through said third and fourth passages respectively and wherein each of said end portions of said filament have knots formed therein which are situated behind said back panel.

6. The frame of claim 1 wherein said front and back panels and said filament are each transparent and wherein said first and second passages extend through both of said panels, said panels having third and fourth passages therethrough which are vertically spaced apart from said first and second passages respectively, and wherein said first and second end portions of said filament extend to the front of said front panel through said first and second passages respectively and extend back through said third and fourth passages respectively, said first and second end portions of said filament having knots formed therein which are respectively situated at the back of said third and fourth passages.

7. A frame for displaying one or more photographs or the like at a wall, comprising:

parallel front and back panels of similar size and configuration, said panels being transpierced by a pair of passages which are situated at opposite side regions of said panels and which are equidistantly spaced from the top of said panels, a filament for suspending said frame from a projection on said wall, said filament having a central portion situated behind said back panel and having end portions which extend through separate ones of said passages to the front of said front panel, and means for preventing withdrawal of said end portions of said filament from said passages when said central portion of said filament is hooked on said projection to suspend said frame at said wall, whereby tension applied to said filament by suspending said frame therefrom acts to join together said front and back panels in compressive assembly.

8. A low visibility frame for displaying at least one photograph or the like on a wall, said frame having parallel front and back panels between which said photograph or the like may be disposed, a filament having a central portion behind said back panel for suspending said frame from a projection on said wall, opposite ends of said filament being connected to opposite side regions of said frame, and having fastening means for holding said panels together by tension in said filament compressively urging said panels together when said frame is suspended from said projection, wherein said panels and said filament and said fastening means are each transparent.

9. The low visibility frame of claim 8 wherein said fastening means includes end portions of said transparent filament which extend through said back panel and engage said front panel.

10. The low visibility frame of claim 8 wherein a pair of spaced apart passages extend through both of said front and back panels at said opposite side regions of said frame, and wherein said fastening means includes end portions of said filament which extend to the front of said front panel through one of said pair of passages at each of said side regions and back to the rear of said back panel through the other of said pair of passages at each side region, said end portions of said filament having enlargements thereon positioned to prevent withdrawal of said end portions from said passages.

11. The low visibility frame of claim 10 wherein said enlargements are knots tied in said end portions of said filament.

12. A frame for displaying one or more photographs or the like on a wall, said frame having a flat transparent back panel having a front surface against which one or more photographs or the like may be positioned, said frame further having a flat transparent front panel of subtantially the same size as said back panel and disposed in parallel overlying relation with said back panel, fastening means for holding said panels together after one or more photographs or the like have been positioned on said back panel so as to be visible through said front panel, said fastening means including a filament extending through opposite edge portions of said frame for suspending said frame from a projection on said wall adjacent the rear surface of said back panel, one of said panels being transpierced by pairs of spaced openings adjacent each of the opposed edge portions of said one panel, the other of said panels being transpierced by at least one opening adjacent each of the opposed edge portions thereof, said filament having a central portion positioned behind said back panel and other portions extending through the openings in each of said panels, and the weight of said panels serves to urge said panels together when said frame is suspended from said wall projection by the central portion of said filament.

13. Apparatus as set forth in claim 12 in which said filament is transparent.

* * * * *